US005967052A

United States Patent [19]

Prokopf

[11] Patent Number: 5,967,052

[45] Date of Patent: Oct. 19, 1999

[54] WALL-MOUNTABLE TOY TRACK ASSEMBLY WITH SCENERY SLOTS

[76] Inventor: Diane T. Prokopf, 5541 S. Wayne, Fort Wayne, Ind. 46807

[21] Appl. No.: 08/897,205

[22] Filed: Jul. 21, 1997

[51] Int. Cl.[6] ..... E01B 23/00

[52] U.S. Cl. ..... 104/126; 238/10 A

[58] Field of Search ..... 104/118, 125, 104/126; 238/10 R, 10 A, 10 E, 10 F; 446/444, 445, 446, 447

[56] References Cited

U.S. PATENT DOCUMENTS

| | | | |
|---|---|---|---|
| 1,188,116 | 6/1916 | Tittle | 104/125 |
| 1,776,640 | 9/1930 | Simmons | 104/56 |
| 1,828,536 | 10/1931 | Koerber | 238/10 E |
| 4,148,152 | 4/1979 | Barlow et al. | 46/216 |
| 4,171,090 | 10/1979 | Eisenburg | 238/10 R |
| 4,386,777 | 6/1983 | Prehodka | 273/86 B |
| 4,826,076 | 5/1989 | Hesse | 104/126 |
| 5,027,712 | 7/1991 | Wallick | 104/94 |
| 5,211,366 | 5/1993 | Cummings | 248/237 |
| 5,342,048 | 8/1994 | Jones et al. | 273/86 B |
| 5,370,308 | 12/1994 | Black | 238/10 R |
| 5,577,448 | 11/1996 | Leung | 104/53 |
| 5,687,649 | 11/1997 | Koeninger et al. | 104/126 |
| 5,779,145 | 7/1998 | Zelle et al. | 238/10 F |

FOREIGN PATENT DOCUMENTS

| | | | |
|---|---|---|---|
| PCT/EP87/00696 | 12/1986 | WIPO | A63H 18/02 |

*Primary Examiner*—Mark T. Le
*Attorney, Agent, or Firm*—Taylor & Associates, P.C.

[57] ABSTRACT

A toy track assembly for use with a toy vehicle is supported by a substantially vertical wall or a substantially horizontal flat surface. The toy track assembly includes at least one scenery cutout, an upper track and a lower mounting having a first mating surface and a rear surface. The first mating surface includes a projection and/or a recess. The rear surface is attachable to the vertical wall. The upper track includes a track surface for carrying the toy vehicle, the track surface having two sides and being oriented orthogonally to the rear surface. The upper track includes two upstanding walls, each of which is disposed substantially parallel and adjacent to a corresponding one of the two sides of the track surface. Each of the two upstanding walls has at least one slot extending substantially parallel to the track surface and configured for receiving the at least one scenery cutout. The upper track includes a second mating surface having a mating projection and/or a mating recess detachably connected to a corresponding projection and/or recess. The second mating surface has a substantially planar contact area for resting on the substantially horizontal flat surface.

10 Claims, 2 Drawing Sheets

WALL-MOUNTABLE TOY TRACK ASSEMBLY WITH SCENERY SLOTS

BACKGROUND OF THE INVENTION

1. Field of the Invention

The present invention relates to toy tracks for toy vehicles, and, more particularly, wall-mountable toy tracks.

2. Description of the Related Art

A toy track is generally an elongated flat surface on which a toy vehicle can travel. On either side of the elongated flat traveling surface typically are upstanding walls or rails running parallel to the track surface. The purpose of the upstanding walls is to block the vehicle from rolling off of the track surface as the vehicle travels down the track, as there is often no steering control of the toy vehicles. The toy vehicles can include toy cars, trucks, trains, etc.

It is known to lay out a toy track on a flat, horizontal surface, such as a floor or table top. It is also known to elevate a toy track off of a horizontal surface by mounting the toy track to a vertical wall, with the track surface remaining horizontal. A problem is that such toy tracks are generally configured to be mounted in only one of the two ways, which limits the ways in which a single track can be arranged. A wall-mounted track cannot be laid out on a floor if the need arises, nor can a track designed to be laid out on a floor be mounted to a vertical wall.

It is also known to place toy buildings, trees, animals, etc. around a toy track to make the scene appear more life-like. A problem is that such toy decorations can easily become displaced and can scatter onto the track surface, blocking the path of the toy vehicles.

What is needed in the art is a toy track assembly capable of retaining decorative items and including a track surface which can be securely mounted in an orthogonal orientation to a wall, yet the track surface can be easily be disconnected from the wall mounting for placement on a horizontal surface.

SUMMARY OF THE INVENTION

The present invention provides a toy track assembly, including slots for retaining scenery cutouts, in which the track surface can be securely mounted in an orthogonal orientation to a wall, yet the track surface can be easily disconnected from the wall mounting for placement on a horizontal surface.

The invention comprises, in one form thereof, a toy track assembly for use with a toy vehicle. The toy track assembly is supported by a substantially vertical wall or a substantially horizontal flat surface. The toy track assembly includes at least one scenery cutout, an upper track and a lower mounting having a first mating surface and a rear surface. The first mating surface includes a projection and/or a recess. The rear surface is attachable to the vertical wall. The upper track includes a track surface for carrying the toy vehicle, the track surface having two sides and being oriented orthogonally to the rear surface. The upper track includes two upstanding walls, each of which is disposed substantially parallel and adjacent to a corresponding one of the two sides of the track surface. Each of the two upstanding walls has at least one slot extending substantially parallel to the track surface and configured for receiving the at least one scenery cutout. The upper track includes a second mating surface having a mating projection and/or a mating recess detachably connected to a corresponding projection and/or recess. The second mating surface has a substantially planar contact area for resting on the substantially horizontal flat surface.

An advantage of the present invention is that the track surface can be laid out on a horizontal flat surface or elevated off of the floor and mounted to a vertical wall. Alternatively, only a portion or portions of the track surface can be elevated off of the floor and mounted to the vertical wall while the remainder of the track surface is laid out on the horizontal surface. This feature supports upward and downward slopes in the track surface.

Another advantage is that the track surface can be quickly and easily attached or detached from the wall mounting via mating projections and recesses.

Yet another advantage is that scenery cutouts can be retained adjacent to the track surface such that the cutouts do not become displaced and scatter onto the track surface or onto the floor.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
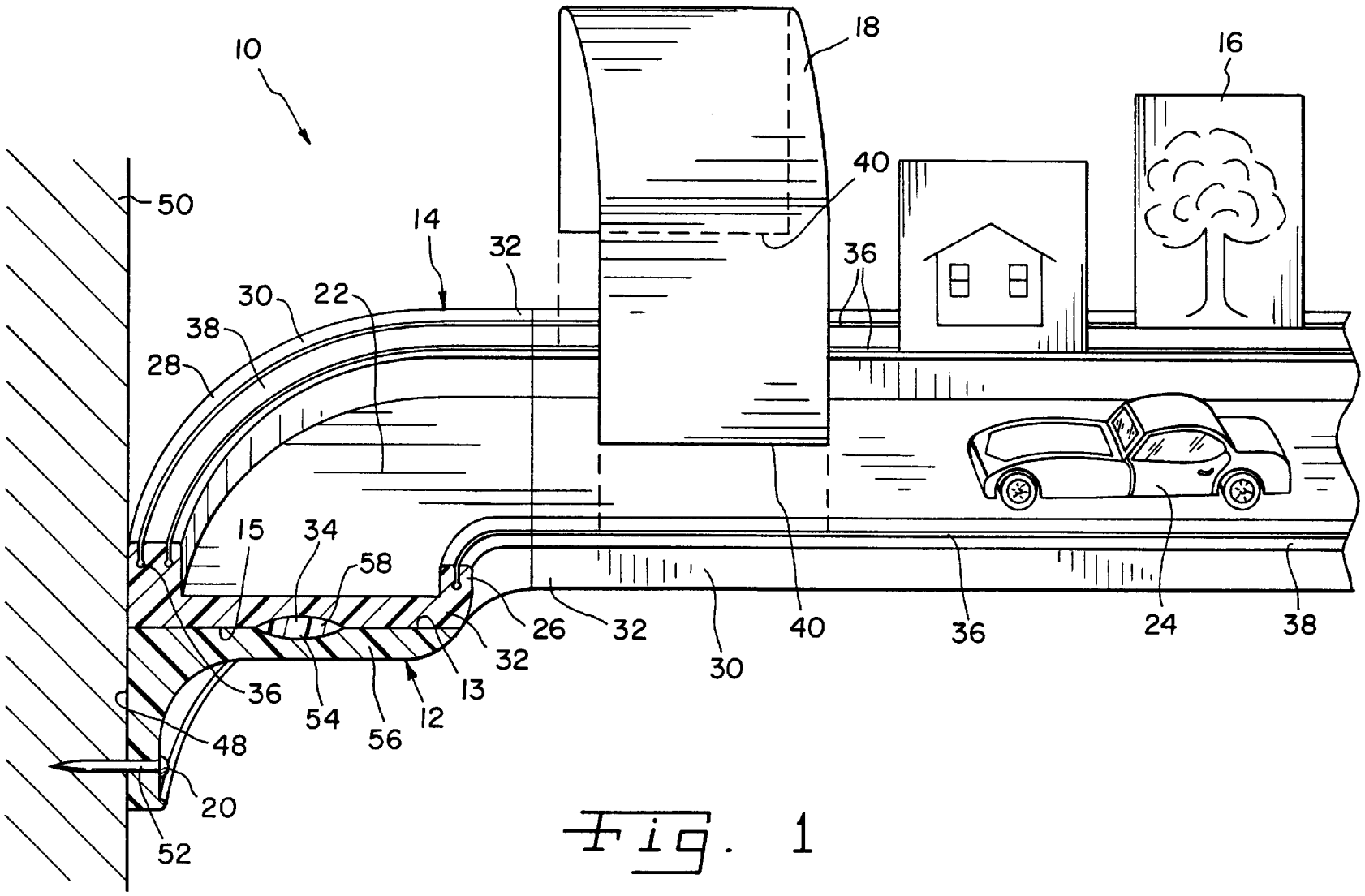
FIG. 1 is a perspective view of one embodiment of a wall-mountable toy track assembly of the present invention with scenery slots.

Referring now to the drawings and particularly to FIG. 1, there is shown a toy track assembly 10 including a lower mounting 12 having a first mating surface 13, an upper track 14 having a second mating surface 15, scenery cutouts 16, an arch 18 and a fastener 20.

Figure 2:
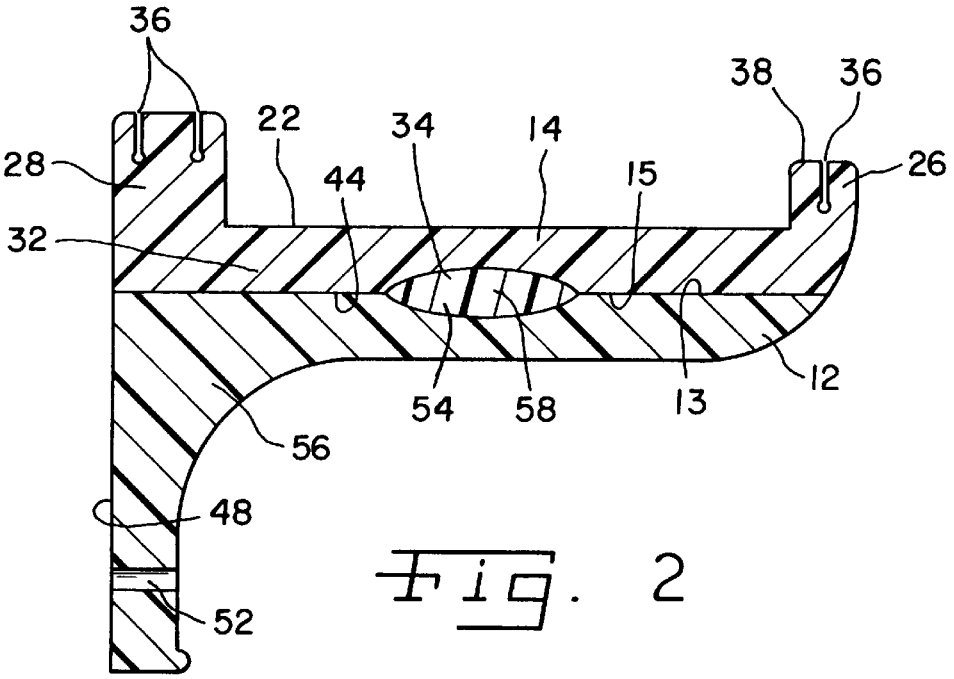
FIG. 2 is a side view of the top track portion and the bottom mounting portion of the toy track assembly of FIG. 1, the top track portion and bottom mounting portion being attached.

Upper track 14 (FIG. 2) includes a track surface 22 on which a toy vehicle 24 can travel. Toy vehicle 24 is blocked from rolling off of track surface 22 by a front wall 26 on one side of track surface 22 and a back wall 28 on the other side of track surface 22. Front wall 26 and back wall 28 each include slots 36 which extend parallel to track surface 22 along the length of an upper surface 38 of both front wall 26 and back wall 28.

Upper track 14 is divided into segments 30 along the length of upper track 14, with each segment 30 including two opposing ends 32, each end 32 having an upper hollow 34. Track segments 30 are each approximately 18 inches long and can be either straight or curved. Track segments 30 are connected end-to-end such that a continuous track surface 22 is formed for toy vehicle 24 to roll upon. Although track segments 30 are shown as being flat, track segments 30, and thus track surface 22, can have downward or upward bends or slopes such that track surface 22 can rise and fall in elevation along its length.

Figure 3:
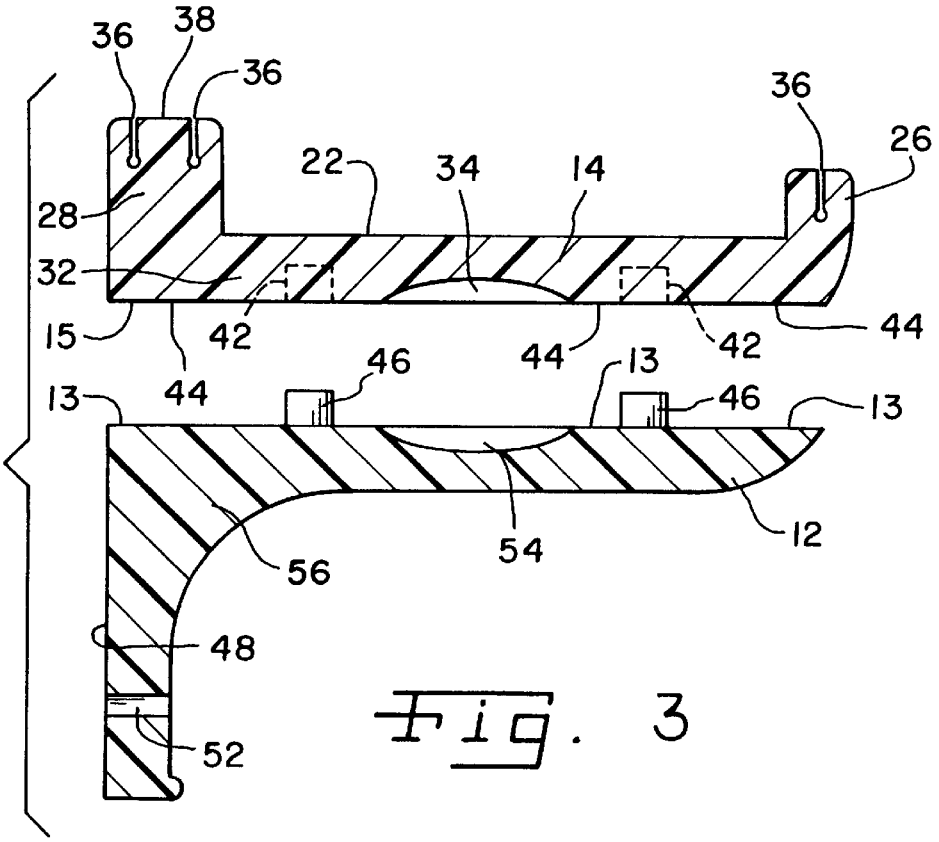
FIG. 3 is a side view of the top track portion and the bottom mounting portion of the toy track assembly of FIG. 1, the top track portion and bottom mounting portion being unattached.

Upper track 14 also includes a second mating surface 15, mating recesses 42 (FIG. 3) and a contact area 44. Contact area 44 is substantially flat or planar so that upper track 14 can be stably rested while in use on a horizontal flat surface, such as a floor or table top. Recesses 42 are shown as being substantially cylindrical. However, it is to be understood that recesses 42 may be of any of numerous shapes and sizes. Recesses 42 may be isolated at certain points along the length or width of second mating surface 15. Alternatively, an individual recess 42 may continuously extend over the length and/or width of second mating surface 15.

Decorative scenery cutouts 16 add realism and attractiveness to the appearance of toy track assembly 10 and can be inserted in any of slots 36 at any point along the length of slots 36. Scenery cutouts 16 are shown only in slots 36 of back wall 28; however, cutouts 16 can also be placed in slot 36 of front wall 26. Arch 18 has two opposing bases 40, one base 40 being inserted in slot 36 of front wall 26 and the other base 40 being inserted in a selected one of the two slots 36 of back wall 28. Arch 18, along with upper track 14, forms a tunnel through which toy vehicle 24 can pass. Scenery cutouts 16 and arch 18 have thicknesses, and slots 36 have corresponding widths, such that cutouts 16 and arch 18 are held securely within slots 36.

Lower mounting 12 includes projections 46 on first mating surface 13. Projections 46 mate with mating recesses 42 on second mating surface 15 in order to attach upper track 14 to lower mounting 12. Projections 46 are shown as being cylindrical in shape in order to mate with cylindrically shaped recesses 42. As can be appreciated, whatever the shape or form of recesses 42, projections 46 must be of a shape to securely mate with recesses 42.

Lower mounting 12 includes a flat rear surface 48 for being placed flush against a vertical wall 50 and being attached thereto. In this condition, when upper track 14 is connected to lower mounting 12 and lower mounting 12 is attached to vertical wall 50, track surface 22 is oriented substantially orthogonally to both rear surface 48 and vertical wall 50. Lower mounting 12 includes a series of through holes 52 (one of which is shown) through which fasteners 20 can be received and inserted into wall 50. Fasteners 20 can include nails, bolts, screws or anchors. In other embodiments (not shown), rear surface 48 is attached to vertical wall 50 by a layer of adhesive or by hook and loop fasteners.

Lower mounting 12 serves to provide a support for elevating upper track 14 off of floor level. Although not visible in the drawings, lower mounting 12 is divided into segments connected end-to-end, corresponding to segments 30 of upper track 14. Each upper hollow 34 of segment ends 32 of upper track 14, together with a corresponding lower hollow 54 of lower mounting segment ends 56, forms a connection cavity 58. A connection dowel or biscuit (not shown) can be inserted into connection cavity 58 with an interference fit in order to interconnect opposing upper segment ends 32 and opposing lower segment ends 56. However, it is to be understood that segment ends 32 and 56 can be connected together by any of a number of well known mechanisms, including for example, tabs or latches. Segment ends 32 and 56 at the beginning and end of track surface 24 can be left unconnected, or can be connected to on-ramps and exit ramps (not shown), respectively. Alternatively, track segments 30 can be connected end-to-end to form a continuous loop as known with toy tracks.

During use, upper track 14 can be detached from lower mounting 12 by pulling upper track 14 and lower mounting 12 apart with enough force to release projections 46 from recesses 42. Upper track 14 may then be rested, in part or in its entirety, upon a flat, horizontal surface such as a floor or desk top. Upper track 14 can be elevated off of the floor and reattached to lower mounting 12 on a wall by mating recesses 42 to projections 46.

In another embodiment not shown in the drawings, mating recesses 42 and projections 46 are switched such that recesses 42 are on the first mating surface 13 of lower mounting 12 and projections 46 are on the second mating surface 15 of upper track 14. In this embodiment, the distal ends of projections 46 together form a substantially flat contact area such that upper track 14 can be rested stably on a horizontal flat surface, such as a floor or desk top.

In yet another embodiment not shown in the drawings, a gap or spacing exists between adjacent segments of lower mounting 12. Segments of lower mounting 12 support upper track 14 intermittently along the length of upper track 14, rather than continuously along the length of upper track 14. Connection cavities or other attachment devices are placed entirely on segment ends 32 of upper track 14, rather than being placed partially on segment ends 56 of lower mountings 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A toy track assembly for use with a toy vehicle and supported by one of a substantially vertical wall and a substantially horizontal flat surface, said toy track assembly comprising:

at least one scenery cutout;

a lower mounting including a first mating surface and a rear surface, said first mating surface having at least one of a projection and a recess, said rear surface being attachable to the vertical wall; and an upper track including a track surface for carrying the toy vehicle, said track surface being oriented orthogonally to said rear surface, said track surface having two sides, said upper track including two upstanding walls, each of said two upstanding walls disposed substantially parallel and adjacent to a corresponding one of said two sides of said track surface, each of said two upstanding walls having at least one slot extending substantially parallel to said track surface and configured for receiving said at least one scenery cutout, said upper track including a second mating surface having at least one of a mating projection and a mating recess detachably connected to a corresponding one of said at least one of a projection and a recess, said second mating surface having a substantially planar contact area for resting on the substantially horizontal flat surface.

2. The toy track assembly of claim 1, wherein at least one of said upper track and said lower mounting comprises a plurality of segments, each of said plurality of segments having two opposing ends, at least one said end of each of said plurality of segments being connected to another said end of another said segment.

3. The toy track assembly of claim 2, wherein each of said plurality of segments is approximately 18 inches long.

4. The toy track assembly of claim 2, wherein at least one of said plurality of segments comprises a substantially curved segment.

5. The toy track assembly of claim 2, wherein said upper track comprises a plurality of first segments, each of said plurality of first segments having two opposing first ends, said lower mounting comprising a plurality of second segments, each of said plurality of second segments having two opposing second ends, at least one said first end of each said first segment of said upper track and at least one said second end of each said second segment of said lower mounting defining a connection cavity.

6. The toy track assembly of claim 1, wherein said two upstanding walls comprise a front wall having one said slot and a back wall having two said slots.

7. The toy track assembly of claim 6, further comprising at least one arch having two opposing bases, one of said two bases being received in said one slot in said front wall and another of said two bases being received in a selected one of said two slots in said back wall.

8. A toy track assembly for use with a toy vehicle and supported by one of a substantially vertical wall and a substantially horizontal flat surface, said toy track assembly comprising:

at least one scenery cutout;

an upper track including a track surface for carrying the toy vehicle, said track surface positioned for orthogonal orientation with respect to the wall, said track surface having two sides, said upper track including two upstanding walls, each of said two upstanding walls disposed substantially parallel and adjacent to a corresponding one of said two sides of said track surface, each of said two upstanding walls having at least one slot extending substantially parallel to said track surface and configured for receiving said at least one scenery cutout, said upper track including a first mating surface having at least one of a projection and a recess, said first mating surface having a substantially planar contact area for resting on the substantially horizontal flat surface;

a lower mounting including a second mating surface, said second mating surface having at least one of a mating projection and a mating recess, said at least one mating projection and mating recess detachably connected to a corresponding one of said at least one of a projection and a recess; and means for attaching said lower mounting to the vertical wall.

9. The toy track assembly of claim 8, wherein said means for attaching said lower mounting to the vertical wall comprises a plurality of through holes, each of said plurality of through holes configured for receiving a fastener therein.

10. A toy track assembly for use with a toy vehicle and supported by one of a substantially vertical wall and a substantially horizontal flat surface, said toy track assembly comprising:

at least one scenery cutout;

a lower mounting including a first mating surface and a rear surface, said first mating surface having at least one of a projection and a recess, said rear surface being attachable to the vertical wall; and an upper track including a continuous, substantially smooth track surface for carrying the toy vehicle, said track surface being oriented orthogonally to said rear surface, said upper track including a second mating surface having at least one of a mating projection and a mating recess detachably connected to a corresponding one of said at least one of a projection and a recess, said second mating surface having a substantially planar contact area for resting on the substantially horizontal flat surface, said upper track having at least one slot extending substantially parallel to said track surface, said at least one slot being configured for receiving said at least one scenery cutout.

* * * * *